United States Patent [19]

Corcoran

[11] 4,403,701

[45] Sep. 13, 1983

[54] EXPANSIBLE RACK FOR LOCKER BASKETS AND GARMENT STORAGE

[76] Inventor: Patrick G. Corcoran, 3014 Rollison Rd., Redwood City, Calif. 94025

[21] Appl. No.: 249,080

[22] Filed: Mar. 30, 1981

[51] Int. Cl.[3] ..... B01D 27/10

[52] U.S. Cl. ..... 211/133; 312/270; 312/213

[58] Field of Search ..... 211/133, 189, 191, 194, 211/128, 126; 312/213, 321, 270; 220/19, 83

[56] References Cited

U.S. PATENT DOCUMENTS

| | | | |
|---|---|---|---|
| 2,172,266 | 9/1939 | Whitaker | 312/213 |
| 2,202,427 | 5/1940 | Polen | 312/213 |
| 2,791,325 | 5/1957 | Schecter et al. | 211/128 X |
| 3,144,161 | 8/1964 | Glenny | 312/213 X |
| 3,231,322 | 1/1966 | Shaw | 312/270 X |
| 3,883,104 | 5/1975 | Delafield | 211/189 X |
| 4,241,668 | 12/1980 | Caaroll | 312/270 X |
| 4,324,076 | 4/1982 | Honickman | 108/29 X |

FOREIGN PATENT DOCUMENTS

| | | | |
|---|---|---|---|
| 672538 | 5/1952 | United Kingdom | 211/133 |

OTHER PUBLICATIONS

Sweet's Catalog File - Products for General Building, 1978, pp. 5, 6, 15.

*Primary Examiner*—William E. Lyddane
*Assistant Examiner*—Peter A. Aschenbrenner
*Attorney, Agent, or Firm*—Julian Caplan

[57] ABSTRACT

A rack consists of plural sections including at least one section having square tubing vertical corner posts and horizontal shelves secured to the posts. Beneath each shelf are guides which grip the top longitudinal edge wires of conventional locker baskets in such manner that the baskets may be slid rearward from the front of the rack and secured against vertical or transverse displacement by pairs of guides. The shelving has a downturned rear flange, which limits rearward sliding of the baskets, and an upturned front flange having rings which may be padlocked to corresponding rings on the baskets. Sections of rack may be assembled by inserting smaller square tubing pieces into the tops and bottoms of the posts of the sections. A coat rack section may be attached to a rack section in similar telescopic fashion. Such coat rack section preferably has a transverse bar at the rear with at least one horizontal bar extending forward from the transverse bar.

4 Claims, 5 Drawing Figures

EXPANSIBLE RACK FOR LOCKER BASKETS AND GARMENT STORAGE

This invention relates to a new and improved expansible rack for locker baskets and garment storage.

More particularly, the invention relates to telescopically interfitting racks for storing locker baskets and also for storing garments. The racks are conveniently assembled by telescopically interfitting splicer sections between the vertical tubing at each corner of the racks. A feature of the invention is the fact that the height of the interfitting racks may be varied by the choice of the number and height of the rack sections which are interconnected. Accordingly, the racks may be conveniently shipped in compact form and then readily assembled at destination.

A feature of the invention is the saving in space achieved by the structure hereinafter described. The compact storage racks may be located conveniently and may readily be moved from place to place if required.

Another feature of the invention is the fact that the racks provide ready visual inspection of the contents of the locker baskets held therein. Since pilferage by employees who regularly store their belongings in lockers is a frequent occurrence, inspection of the locker baskets without actual physical access to the contents thereof, is an important advantage of this invention. Additionally, the racks are relatively open to air circulation and hence are ventillated.

A still further feature of the invention is the fact that the baskets, when locked in place, are secure against theft. The baskets themselves are of a commercially available type. However, the racks hereinafter described secure the baskets in a manner so that they cannot be opened without opening the locks which are used therewith.

Another feature of the invention is the provision of an optional coat rack section which may be attached to the top of a locker section in the same manner that the locker sections are interfitted. Hence, means is provided for hanging garments on ordinary coat hangers and nearby securely storing valuables in a locker basket.

Other objects of the present invention will become apparent upon reading the following specification and referring to the accompanying drawings in which similar characters of reference represent corresponding parts in each of the several views.

Figure 1:
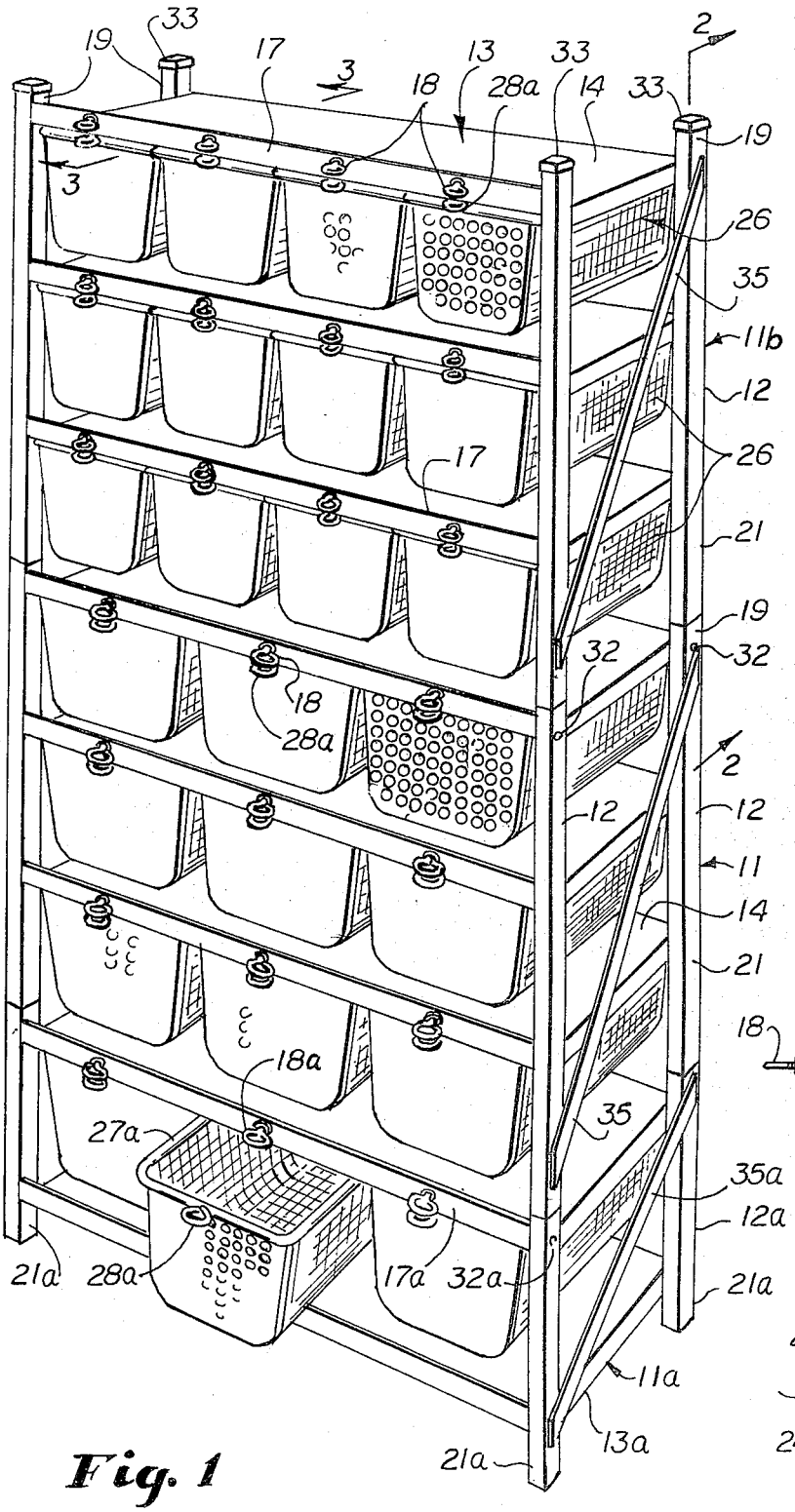
FIG. 1 is a perspective view of one form of the invention showing a single locker basket tier section at the bottom, a three tier locker basket section superimposed thereon and still another three tier locker basket section superimposed at the top.

Illustrated in FIG. 1 are several locker basket rack sections superimposed one upon the other. The lowermost section 13a contains three locker baskets, but could readily be modified to contain more or less such baskets in a horizontal layer. Superimposed upon section 11a is section 11 which contains three tiers of three baskets each and is connected to section 11a by means hereinafter explained. Superimposed upon section 11 is section 11b which contains three tiers of four locker baskets each. The number of tiers in each section and the number of baskets in each tier is subject to variation as will readily occur to one skilled in the art.

Each section 11, 11a and 11b is constructed of corner posts 12 which are preferably mechanical square tubing. Secured as by welding to each section are at least two shelves 13. Each shelf 13 has a horizontal surface 14. The rear edge 16 of the horizontal surface 14 is bent downward to serve as a stop limiting inward movement of a basket 26 inserted in the rack. The front edge 17 is bent up and receives one or more rings 18 permanently secured thereto and used, as hereinafter explained, to cooperate with a similar ring 28 on the basket 26, so that a padlock can be inserted through the two rings to secure the basket in place.

As best shown in FIG. 1, each corner post 12 has an upward projection 19 extending above the topmost shelf which is used to secure the section to a superimposed section if required. Similarly, each corner post 12 has a leg 21 extending below the lowermost shelf which may be used to support the section on the floor (see section 11a in FIG. 1) or may be used to join a section to the upper projection 19 of the corner post 12 of a lower section.

Figure 4:
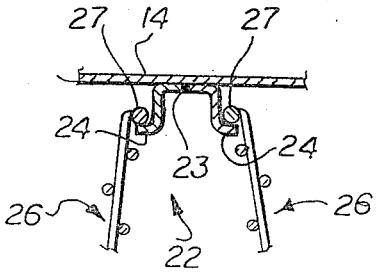
FIG. 4 is an enlarged fragmentary view of the underside of a shelf showing guides to secure the locker baskets in place.

On the underside of each shelf 13 are guides 22 which are spaced apart the width of a basket 26. Directing attention to FIG. 4, each guide 22 is secured to the underside of the horizontal surface 14 of shelf 13, as by welding. The edges, or flanges, 24 of guide 22 are bent downwardly and then generally horizontally outwardly to secure the baskets 26. Baskets 26 are commercially available and have edge wires 27 received between the horizontal surface 14 and the flanges 24. Referring to FIG. 1, it will be seen that the baskets 26 may be slid under each shelf 13 by locating the wires 27 between two adjacent guides 22. It will be understood, of course, that the guides 22 are properly spaced for the particular baskets 26 being accommodated. Thus, in the rack section 11 of FIG. 1 there are three baskets 26 in each tier while in the upper section 11b there are four smaller baskets in each tier. The width of the baskets is a matter of choice.

Figure 2:
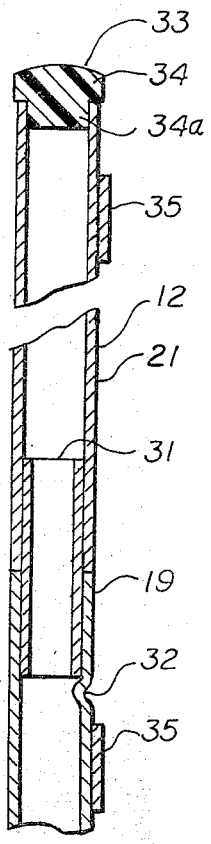
FIG. 2 is an enlarged fragmentary sectional view taken substantially along line 2—2 of FIG. 1, the view being broken away to conserve space.
Figure 3:
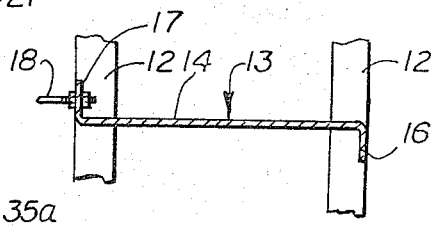
FIG. 3 is a transverse horizontal sectional view taken substantially along the line 3—3 of FIG. 1 with parts omitted for clarity.

As best shown in FIG. 2, the corner posts 12 of adjacent sections are joined together by means of splicing sections 31 which are of tubing dimensioned to fit inside the tubing 12. To prevent the splice section 31 from dropping downwardly, a dimple 32 may be struck in one of the faces of the lower tubing 12. Accordingly, in order to instal the section 11b over the section 11, a splice section 31 is inserted in each leg 12, the bottom of the section 31 being restrained by the dimple 32. Thereupon the section 11b is inserted on top of the splice section 31.

To close off the top of each leg 12 on the upper rack 11b, caps 33, best shown in FIG. 2 are installed. These caps have a top which is as large as or larger than the dimensions of the leg 12 and preferably rounded at the top. Below the top 34 is a reduced sized portion 34a which fits inside the upper projection 19 of the leg 12.

Braces 35 may be installed between corner posts 12 as required to rigidify the structure.

The lowermost section 11*a*, as has been stated, is only one tier high. The same reference numerals followed by the subscript a are used to designate corresponding parts in the lower section 11*a*.

Figure 5:
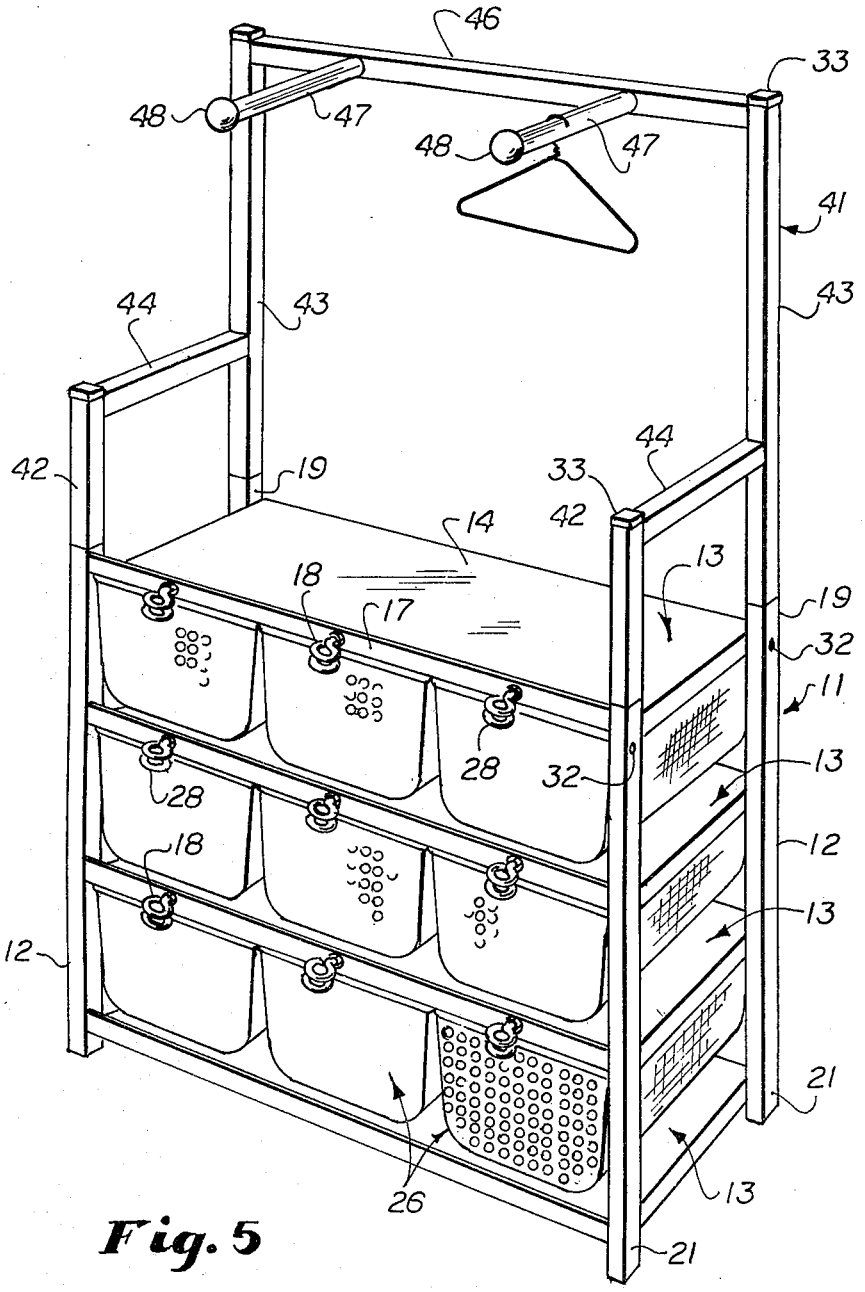
FIG. 5 is a perspective view somewhat similar to FIG. 1 showing a three tier locker basket section at the bottom with a coat rack section superimposed thereon.

Directing attention now to the form of the invention shown in FIG. 5, the lower section 11*c* is identical to the section 11 shown in FIG. 1. A coat rack section 41 is superimposed thereon using the same splicing means 31 (not shown in FIG. 5) to join the corner posts 12 and 42, 43. The structure shown in FIG. 5 employs two front posts 42 which are joined to the front post 12 of the section 11 and two higher rear posts 43 which are joined to the rear corner posts 12. Longitudinal braces 44 connect the tops of the posts 42 with the posts 43. The upper ends of the posts 43 are joined by horizontal transverse brace 46. One or more forward projecting bars 47 extend from the brace 46. Stops 48 are of greater diameter than the bars 47 are installed on the forward ends of the bars 47. Accordingly, in the form of the invention shown in FIG. 5 coat hangers containing the garments of the users of the locker baskets of the section 11*c* are hung from the bars 47. The stops 48 prevent the coat hangers from being displaced forwardly.

What is claimed is:

1. An extensible rack for locker baskets of the type having open tops defined by top boundary wires extending longitudinally of said baskets comprising a plurality of rectangular shelves horizontally spaced apart, vertical posts at the corners of said rack attached to said shelves, a plurality of guides fixed to the undersides of at least some of said shelves each said guide comprising a flat, horizontal central portion fixed to the underside of a shelf and on either longitudinal edge of said central portion a substantially vertical stretch extending downward and a substantially horizontal outwardly extending flange, said guides being spaced apart so that the two longitudinal top boundary wires of each of a plurality of baskets fit over opposed flanges and under the shelf to which said guides are fixed to restrain said baskets against horizontal transverse and vertical displacement, said flanges supporting said baskets spaced slightly above the shelf next below the shelf to which said guides are fixed, and cooperating locking means on said baskets and said shelves to restrain said baskets against horizontal longitudinal displacement.

2. A rack according to claim 1 in which a forward edge of at least one said shelf is upwardly turned, said cooperating locking means comprising aligned rings fixed to said baskets and said forward edge, and a rearward edge of said shelf is downwardly turned to limit rearward movement of said basket.

3. A combined locker basket and coat storage rack comprising a lower section comprising a rack for locker baskets of the type having open tops defined by top boundary wires extending longitudinally of said baskets comprising a plurality of rectangular shelves horizontally spaced apart, vertical posts at the corners of said rack attached to said shelves, a plurality of guides fixed to the undersides of at least some of the shelves having outwardly-downwardly slanted flanges, said guides being spaced apart so that the two longitudinal top boundary wires of each of a plurality of baskets fit over opposed flanges and under the shelf to which said guides are fixed to restrain said baskets against horizontal transverse and vertical displacement, and cooperating locking means on said baskets and said shelves to restrain said baskets against horizontal longitudinal displacement, said corner posts being open at the top, a coat rack section, and splice means for holding said sections superimposed, and aligned, said coat rack section comprising four coat rack corner posts aligned with said corner posts, longitudinal corner braces joining front and rear corner posts at each side of said coat rack, a transverse brace joining the tops of said rear corner posts, and at least one bar adapted to receive a coat hanger projecting forward from said transverse brace.

4. A rack according to claim 3 in which each said corner post is made of hollow tubing and said splice means comprises a member shaped to fit into aligned open ends of the superimposed corner posts of said locker basket and coat storage rack sections with a sliding fit and means to restrain movement of said member so that it is partially within the corner posts of each of said superimposed racks.

* * * * *